United States Patent [19]

Zeijdel et al.

[11] 4,164,350

[45] Aug. 14, 1979

[54] APPARATUS FOR SUPPORTING THE BODY OF A PERSON IN AN UPRIGHT POSITION, IN PARTICULAR FOR THERAPEUTIC WALKING EXERCISES

[75] Inventors: August-Eden Zeijdel, The Hague; Rudolf B. Teunissen, Noordwijk, both of Netherlands

[73] Assignee: N.V. Verenigde Instrumentenfabrieken Enraf-Nonius, Delft, Netherlands

[21] Appl. No.: 898,117

[22] Filed: Apr. 20, 1978

[30] Foreign Application Priority Data

Apr. 21, 1977 [NL] Netherlands ..... 7704344

[51] Int. Cl.[2] ..... A61H 3/04

[52] U.S. Cl. ..... 272/70

[58] Field of Search ..... 272/70.3, 70.4, 24, 272/70; 297/5, 6

[56] References Cited

U.S. PATENT DOCUMENTS

| | | | |
|---|---|---|---|
| 823,812 | 6/1906 | Ritter | 272/70.3 |
| 2,327,671 | 8/1943 | Ruppecht | 272/70 |
| 2,362,466 | 11/1944 | Carter | 297/6 |

FOREIGN PATENT DOCUMENTS

| | | | |
|---|---|---|---|
| 586404 | 12/1958 | Italy | 297/5 |

*Primary Examiner*—Anton O. Oechsle

*Attorney, Agent, or Firm*—Lane, Aitken & Ziems

[57] ABSTRACT

Apparatus for supporting the body of a person in an upright position to relieve the load of the person's legs, in particular for therapeutic walking exercises, including a seat ring suspended by a cable from a trolley movable on an overhead track. The seat ring has in its rear section an inwardly projecting body support member shaped to engage below the tuber ischii of the person's body and said seat ring having a front section provided with an adjustable pressure pad projecting inwardly from the seat ring front section in opposite relation to the support member, which adjustable pressure pad can be pressed against the symphysis of the pubic bones of the body resting on the body support of the seat ring.

12 Claims, 3 Drawing Figures

APPARATUS FOR SUPPORTING THE BODY OF A PERSON IN AN UPRIGHT POSITION, IN PARTICULAR FOR THERAPEUTIC WALKING EXERCISES

BACKGROUND OF THE INVENTION

The present invention relates to apparatus for supporting the body of a person in an upright position to relieve the load on the person's legs, in particular for therapeutic walking exercises. Such apparatus generally comprise, apart from means for receiving and supporting the lower part of the person's body, an overhead suspension assembly, including a suspension cable or the like, for movably supporting the body receiving means.

Apparatus of this kind are used in physiotherapy for the treatment of patients whose lower limbs do not function properly. The suspension cable means may comprise an adjustable resilient tensioning arrangement whereby the supporting force to which the body is subjected can be regulated depending on the circumstances, with the additional effect that the supporting force increases as the patient bends his knees further, Generally, the suspension means is connected to a trolley or the like movable on an overhead track whereby the patient can make walking movements while being supported by the suspended body receiving means.

In a known apparatus of this type (see the U.S. Pat. No. 3,204,954 to Scannell) the body receiving means comprises a horizontally extending circular bar adapted to be placed around the patient's body with ample room for play and having a depending strap-like seat element suspended therefrom for the patient to seat on. A further circular bar spaced above this first bar serves as an arm rest for the patient's arms. According to another known invalid-exerciser (see U.S. Pat. No. 1,384,215 to Scott & Whitcomb) a circular bar with arm rests is carried by a supporting frame mounted for rotation about a vertical upright, which circular bar supports a seat element in the form of a saddle therebelow.

These known apparatus have the disadvantage that the patient's body is not supported in a natural upright position for walking and that the strap-like or saddle-shaped seat element is apt to press against the groins of the body whereby the patient is hindered in the free and natural use of the muscles involved in normal walking movements.

The invention has for its main object to provide an apparatus of the above-mentioned character which obviates these disadvantages and which is adapted to partly or completely support the patient's body so that the lower extremities and also the other body parts involved in walking keep their complete freedom of normal movement.

Another object of the invention is to provide such an apparatus which can accommodate persons of widely diverging body sizes, can be easily cleaned and can be quickly and simply arranged about and removed from the patient's body.

SUMMARY OF THE INVENTION

A body receiving means of the apparatus according to the invention comprises a rigid seat ring member adapted to receive and freely surround the pelvis of the body with ample room for play, which seat ring member has a rear section provided with an inwardly projecting body support member shaped to engage below the tuber ischii of the body and the ring member having a front section provided with a pressure pad member adjustably mounted thereon and projecting inwardly therefrom in opposite relation to the support member, means being provided for adjusting the spacing between the support member and the pad member to allow the latter to be pressed against the symphysis of the pubic bones of the body resting on the support member. The seat ring member may be rigidly secured to an upwardly extending supporting frame attached at its upper side to the suspension means, an adjustable belt being attached to this frame to be secured about the patient's body. The body support member can be simply formed by an inwardly projecting V-shaped part of the rear section of the seat ring member which part preferably is covered with a suitable padding material.

The seat ring member of the invention makes it possible to support the patient's body on the body support member exclusively in a centrally located point below the tuber ischii in an anatomically correct vertical position, the adjustable pressure pad preventing the patient from slipping down forwardly from this body support member. The clamping pressure exerted on the body by the pressure pad is thus directed substantially horizontally along a central axis extending approximately perpendicular to the body between the symphysis of the pubic bones and the tuber ischii whereby the pelvis is free to swing about this axis. The central part of the symphysis and the two tuber ischii thus form the only fixedly engaged parts of the body in the lower region, the seat ring not engaging any other body parts. The hip-joints and the sacrumjoints as also at least the greater part of the vertebral column remain completely free while there is no pressure on the belly and the gluteal muscles. As a consequence, the natural walking movements and also knee-bending exercises are not in any way impeded while the muscular activity and the lumbar rotation during walking can be properly observed.

Measurements have shown that in full-grown persons there is only relatively litle divergence in the width and circumference of the pelvis so that in practice it is generally possible to use a seat ring of a single size. The seat ring and the supporting frame secured thereto can be made from metal tubing, for instance aluminium tubes, whereby a light-weight assembly is obtained which can be easily cleaned. The supporting frame preferably comprises two supporting bars fixedly secured to the seat ring on either side of the body support member so as to extend upwardly therefrom along the backside of the patient, which supporting bars terminate at their upper side in brace parts extending horizontally forwardly across the patient's shoulders and through suspension straps.

The belts are preferably vertically adjustable on the vertically extending supporting bars of the frame while also the suspension straps can be horizontally adjustable on the brace parts at the upper ends of the supporting bars. It is thereby possible to correct the position of the lumbar vertebral column, that is to tilt the pelvis forwardly or backwardly. For instance, by arranging the belt across the belly or across the two upper forward protubrances of the iliac bones the pelvis can be tilted backwardly to decrease lordosis of the vertebral column. A silimar result can also be obtained by adjustment of the suspension straps on the horizontale braces of the frame, because the point of suspension is thereby moved with respct to the centre of gravity of the body.

If these suspension straps are adjusted forwardly lordosis is counteracted and if shifted rearwardly lordosis is promoted.

SHORT DESCRIPTION OF THE DRAWINGS

The accompanying drawings illustrate a preferred embodiment of the apparatus of the invention.

PREFERRED EMBODIMENT OF THE INVENTION

Figure 1:
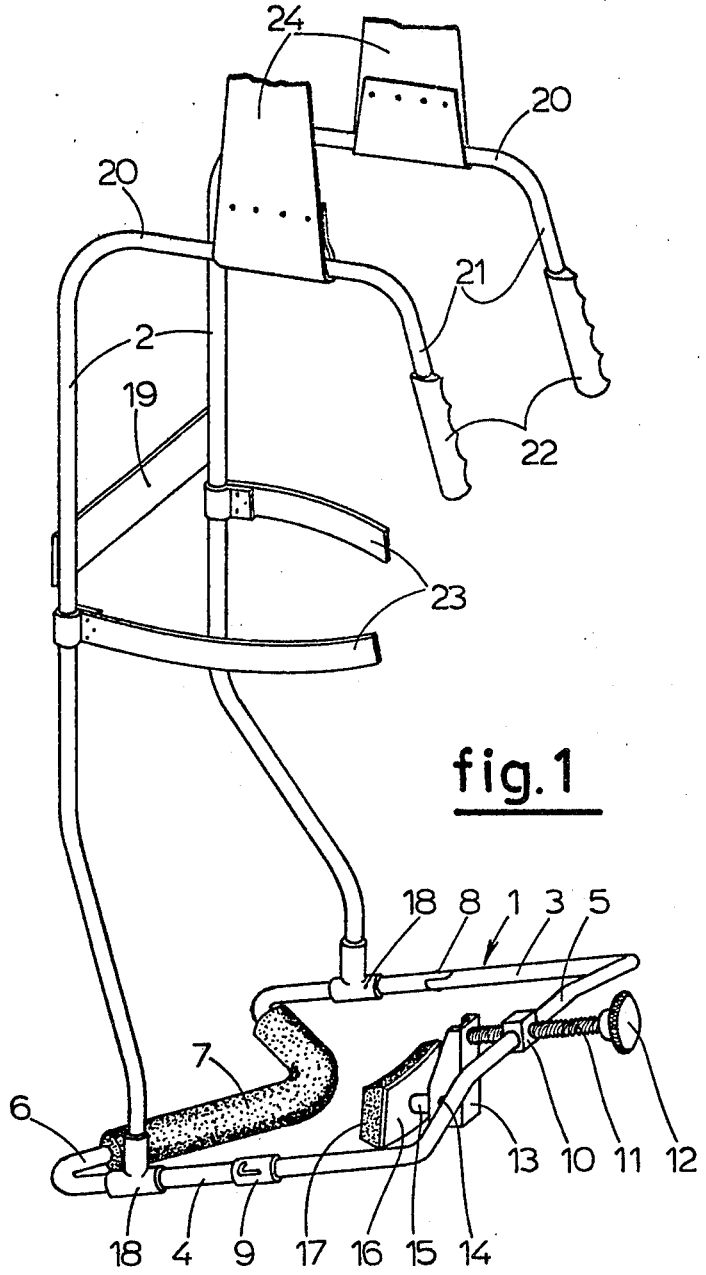
FIG. 1 is a perspective view of the apparatus.
Figure 2:
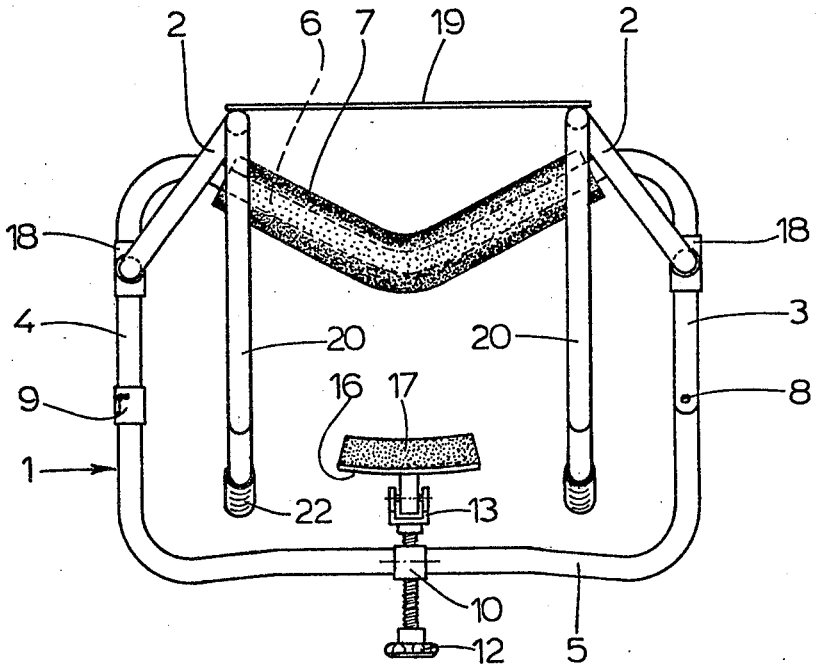
FIG. 2 is a plan view of the apparatus of FIG. 1 without the suspension straps.

Referring to the drawings, the apparatus comprises a seat ring member 1 rigidly secured to two upwardly extending supporting frame members or bars 2, the seat ring and supporting bars being made from aluminium tubes.

The seat ring has straight side bars 3 and 4, an upwardly bent front ring section 5 and a rear ring section bent forwardly to form an inwardly projecting V-shaped body support 6 which is covered with a layer of a suitable padding material 7. The seat ring 1 is made in two parts by dividing the side bars 3 and 4 in half, which parts are joint by a hinge-connection 8 in the side bar 3 while at the opposite side bar 4 the meeting ends of the ring parts are releasebly connected by a slidable locking sleeve means 9 with bayonet lock. By manipulation of this locking sleeve means 9 the seat ring can thus be opened in a simple way and then again be closed and locked around the body of a patient. The seat ring 1 is of such a size that it can surround the pelvis of the patient with ample room for lateral play in which, however, he inwardly projecting V-shaped body support 6, 7 can be arranged to engage underneath the tuber ischii of the patient's body.

The front section 5 of the seat ring 1 is midway of its length provided with a nut member in the form of a block 10 with a threaded bore accommodating a screw spindle 11 extending parallel to the side bars 3 and 4 and having a hand-knob 12 at its outer end. A downwardly extending link member 13 is secured for free pivotable movement to the inner end of the screw spindle 11 inside The seat ring 1 and the lower end of the link member 13 has an inwardly extending arm 15 pivotably connected thereto by means of a horizontal pivot pin 14. A slightly curved pressure plate 16 is fixedly secured to the free end of the arm 15 which plate 16 is covered with a pad 17 of resilient material. The padded pressure plate 16 is thus situated opposite the forwardly projecting central part of the body support 6, 7 of the seat ring, but can freely pivot about the pivot pin 14 with respect to this body support. The spacing between the body support 6 and the padded pressure plate 16 can be adjusted by turning the screw spindle 11 whereby the pad 17 can be pressed against the symphysis of the pubic bones of the body of a patient resting with his tuber ischii on the padded body support 6 so as to prevent the patient from slipping off this body support in the forward direction.

Figure 3:
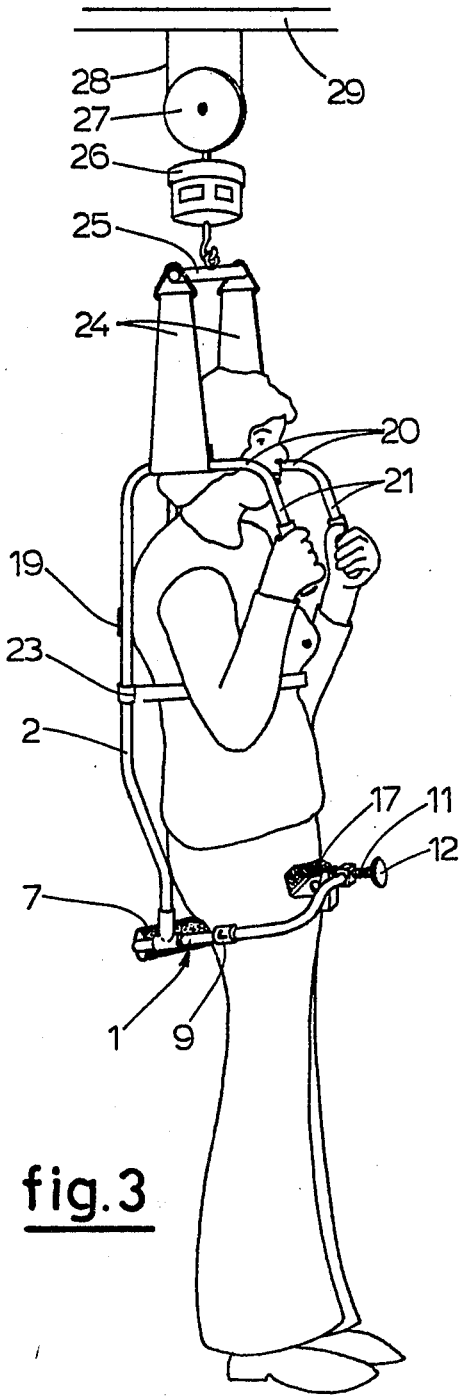
FIG. 3 is a perspective view of the apparatus of FIGS. 1 and 2 suspended from a cable and with a patient placed therein.

The supporting bars 2 are secured to the seat ring 1 by means of T-members 18 welded to the side bar portions of the rear seat ring part adjacent the body support member 6. From these T-members 18 the bar 2 first extend obliquely rearwardly and inwardly towards ech other in the upward direction and then continue substantially vertically upwardly parallel to each other, in such a manner that these upper vertically extending bar portions which are connected by a cross member 19 will be situated behind the back of a patient sitting on the body support 6. At their upper ends the supporting bars 2 have forwardly bent horizonally extending brace parts 20 which terminate in obliquely forwardly and downwardly extending end parts 21 carrying hand-grips 22. Two belt parts 23 are attached to the vertical upper parts of the supporting bars 2 so as to be vertically adjustable thereon, which belt parts 23 can be closed around the patient's body by means of a suitable buckle (not shown). The horizontal brace parts 20 extend through loops formed at the lower ends of two broad suspension straps 24 which are adjustable lengthwise of the brace parts 20. As schematically shown in FIG. 3, these suspension straps 24 have eyes at their upper ends which are hooked on a cross bar 25 which is suspended midway of its length to a hook of a weight measuring device 26. This measuring device 26 is supported on a pulley 27 for a suspension cable 28 which extends to a trolley (not shown) running on an overhead track 29 in a manner well-known in the art and therefore not further shown in detail. As is also known in the art, the suspension cable 28 of adjustable length may be connected to a tensioning means of adjustable spring force so that the extent to which the load on the patient's legs is relieved can be regulated. The load on the cable 28 exerted by the patient can be read on the weight measuring device 26.

In the use of the above-described apparatus, the seat ring 1 is opened and arranged with its body support 6, 7 underneath the tuber ischii of the patient's body, during which operation the patient can keep himself upright by holding the hand-grips 22. The seat ring is then closed and locked by means of the locking sleeve 9, whereupon by turning the hand-knob 12 the padded pressure plate 16 is moved inwardly and pressed against the symphysis of the patient's body, the pivot pin 14 allowing the plate 16 to be arranged at the proper angle. The patient may now rest his full weight on the body support 6, 7, the pressure plate 16 preventing him from slipping off this support. The belt parts 23 are then closed about the patient's body in which as above described the vertical position of the belt parts and also the lengthwise position of the suspension straps 24 on the horizontal brace parts 20 can be properly adjusted to obtain the desired forward or backward tilting of the pelvis. The patient can now make knee-bendings and walking movements during which his legs are relieved from his body-load by the resilient suspension cable 28 to the desired adjustable extent. The natural walking movements are not in any way impeded by the seat ring 1 and the supporting bars 2, as has been explained above.

Although the invention has been described with reference to a preferred embodiment thereof, other embodiments may be resorted to within the scope of the following claims.

What is claimed is:

1. Apparatus for supporting the body of a person in an upright position to relieve the load on the person's legs, in particular for therapeutic walking exercises, including means for receiving and supporting the lower part of the person's body and a suspension assembly for movably supporting said body receiving means, said body receiving means comprising a rigid seat ring member adapted to receive and freely surround the pelvis of the body with ample room for lateral play, said seat ring member having a rear section and a front section, said rear section being provided with an inwardly projecting body support member shaped to engage below the tuber ischii of the body, a pressure pad member adjustably mounted on said seat ring front section and projecting inwardly therefrom in opposite relation to said body support member, and means for adjusting the spacing between said body support member and said pressure pad member to allow said pressure pad member to be pressed against the symphysis of the pubic bones of the person's body resting on said body support member.

2. The apparatus of claim 1, in which said seat ring member is rigidly secured to an upwardly extending supporting frame attached at its upper side to said suspension means, and an adjustable belt means attached to said frame to be secured about the person's body.

3. The apparatus of claim 2, in which said supporting frame of the seat ring member comprises two supporting bars fixedly secured at their lower ends to said seat ring member on either side of and adjacent to said body support so as to extend upwardly therefrom along the back of a person's body supported in said seat ring member, said supporting bars terminating at their upper ends in brace parts adapted to extend substantially horizontally forwardly across the shoulders of said person, said suspension means comprising suspension straps through which said brace parts extend.

4. The apparatus of claim 3, in which said supporting bars have first portions extending upwardly from said seat ring member at a rearwardly and inwardly directed angle, and second portions extending upwardly parallel to each other from said first portions.

5. The apparatus of claim 3, in which said brace parts have downwardly extending forward end portions carrying hand-grips for the person to hold.

6. The apparatus of claim 3, further comprising belt means adapted to be closed about the person's body, said belt means being vertically adjustably attached to said supporting bars.

7. The apparatus of claim 3, in which said suspension straps are horizontally adjustable on said brace parts.

8. The apparatus of claim 1, in which said body support member is formed by an inwardly projecting V-shaped part of said seat ring member rear section.

9. The apparatus of claim 8, in which said V-shaped body support member is covered with padding material.

10. The apparatus of claim 1, in which said pressure pad member comprises a rigid plate member and a layer of resilient material on said plate member, said plate member being pivotably supported on said adjusting means for free swinging movement about a horizontal axis.

11. The apparatus of claim 10, in which said adjusting means comprise a nut member fixedly secured on said front section of said seat ring member, a screw spindle extending through said nut member in a direction substantially perpendicular to said front section and carrying a hand-knob at its outer end, a link member rotatably but axially non-slidably mounted on the inwardly turned end of said screw spindle, said plate member being pivotably secured to said link member.

12. The apparatus of claim 1, in which said seat ring member consists of two ring parts, one comprising said rear section and one said front section, hinge means connecting the corresponding ends of said two seat ring parts at one side of said seat ring, and releasable lock means connecting the corresponding ends of said two seat ring parts at the opposite side of the seat ring member, whereby said seat ring member can be opened to receive the body of a person and can be closed about said body.

* * * * *